United States Patent [19]

Goodman

[11] 4,328,754

[45] May 11, 1982

[54] TIME DELAY DEVICE

[75] Inventor: Graeme D. Goodman, Ferntree Gully, Australia

[73] Assignee: Commonwealth of Australia, Canberra, Australia

[21] Appl. No.: 133,899

[22] Filed: Mar. 25, 1980

[30] Foreign Application Priority Data

Mar. 26, 1979 [AU] Australia ..... PD8199

[51] Int. Cl.[3] ..... F42C 9/06

[52] U.S. Cl. ..... 102/277; 102/228; 267/114

[58] Field of Search ..... 102/277, 276, 257, 255, 102/250, 228; 267/114; 138/40–44; 175/227–229; 184/7 R

[56] References Cited

U.S. PATENT DOCUMENTS

| | | | |
|---|---|---|---|
| 1,333,667 | 3/1920 | McCabe . | |
| 2,455,958 | 12/1948 | Taylor . | |
| 2,896,540 | 7/1959 | Voland . | |
| 3,182,594 | 5/1965 | Harris et al. | 102/277 |
| 3,220,496 | 11/1965 | Beck | 184/7 R X |
| 3,261,293 | 7/1966 | Webb . | |
| 3,296,969 | 10/1966 | Mueller et al. | |
| 3,344,372 | 9/1967 | Heilman . | |
| 3,415,190 | 12/1968 | Hart et al. | 102/277 X |
| 3,430,568 | 3/1969 | Amster | 102/257 |
| 3,642,030 | 2/1972 | Amick | 138/44 X |
| 3,726,518 | 4/1973 | Halik | 102/277 X |
| 3,739,725 | 6/1973 | Heinemann | 102/257 |
| 3,766,733 | 10/1973 | Drzewiecki et al. | |
| 3,919,941 | 11/1975 | Breed et al. | 102/250 |
| 4,109,455 | 8/1978 | Zacharin | 102/277 X |

FOREIGN PATENT DOCUMENTS

| | | | |
|---|---|---|---|
| 2218617 | 10/1973 | Fed. Rep. of Germany . | |
| 1143778 | 10/1957 | France . | |
| 537577 | 6/1941 | United Kingdom | 102/277 |

*Primary Examiner*—David H. Brown

*Attorney, Agent, or Firm*—Schwartz, Jeffery, Schwaab, Mack, Blumenthal & Koch

[57] ABSTRACT

A time delay device adapted to cooperate with a firing device. The time delay device comprises a piston cooperating with the firing device, a spring to move the piston between a first position in which the firing device remains in a non-operating condition and a second position in which said firing device is allowed to operate, a retractable pin to hold the piston in the first position, a reservoir of fluid adapted to be acted upon by the piston and communicating with a length of small bore or micro-bore tubing whereby upon movement of the piston fluid will be displaced from the reservoir through said tubing, with the rate of movement of the piston, and therefore the time for the piston to move from the first to the second position under the action of said spring, being dictated by the viscosity of the fluid in the reservoir and the length of the tubing. A predetermined time delay is therefore produced between actuation by retraction of the pin and movement of the piston under the action of said spring to the second position to allow operation of the firing device. A temperature compensating device is also disclosed.

10 Claims, 7 Drawing Figures

TIME DELAY DEVICE

Figure 1:
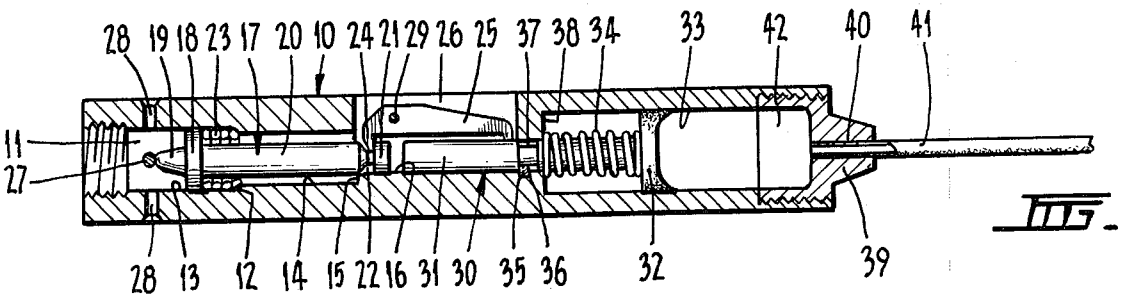

This invention relates to a time delay device, and more particularly, but not exclusively, to a time delay device for a firing device demolition.

Time delay devices for use with mines or demolition charges currently consist of cord type safety fuses, electric, electronic and mechanical clocks, and chemical acting devices utilising the corrosive effect of an acid on wire.

The use of cord type safety fuses is restricted to applications of relatively short time duration according to their burning rate, and for relatively long time delays would require large lengths, resulting in a greater weight factor as well as cost. Furthermore, safety fuses when activated produce relatively large quantities of smoke which is of disadvantage in situations where detection is to be avoided.

The use of clocks is quite reliable even over long time durations, and unlike safety fuses, they do not produce detectable smoke. However, clock devices are relatively expensive, whilst electric or electronic clocks require the use of batteries. Clock devices are also relatively large and often delicate and easily damaged if handled roughly or exposed to adverse environmental conditions such as rain and/or mud.

Chemical type devices usually consist of a glass vial containing an acid mounted adjacent a spring loaded wire restraining a firing pin, such that when the vial is broken the acid spills over the wire and after the time delay taken for the wire to corrode through under the action of the acid the firing pin is released. However, these chemical devices are extremely sensitive to temperature and for the same device the time delay may vary between several hours to many days under varying conditions. Also there is no indication how quickly the wire will break under the corrosive action, and should the glass vial be subjected to internal damage the possibility that the wire will break almost immediately can lead to serious accidents in relation to personnel handling the devices.

It is an object of the present invention to provide an accurate time delay device of low cost, weight and bulk, whilst being simple and safe to operate and use as well as rugged and insensitive to environmental conditions.

The invention may be utilised with a firing device demolition of a type to be later described, although the invention is also applicable for use with any form of associated equipment or firing device for which a time delay is required between actuation and the actual operation thereof.

The invention may therefore envisage a time delay device adapted, in use, for cooperation with a piece of equipment for which a time delay is required between an actuating action and subsequent operation thereof; said time delay device comprising a piston means cooperating, in use, with said equipment, biasing means to move said piston between a first position in which the equipment remains in a non-operating condition and a second position in which said equipment is allowed to operate, holding means to hold said piston member in said first position, a reservoir of fluid adapted to be acted upon by said piston means, said reservoir communicating with an extended passage means whereby upon movement of said piston means fluid will be displaced from said reservoir through said passage means, with the rate of movement of said piston means, and therefore the time for said piston means to move from said first to said second position under the action of said biasing means, being dictated by the viscosity of the fluid in the reservoir and the length of the passage means, thus providing a predetermined time delay between actuation by release of said holding means and movement of said piston means under the action of said biasing means to said second position to allow operation of said equipment.

Preferably the equipment with which the time delay device cooperates in use is of the type having locking means cooperating with operating means and adapted in one position to hold said operating means in a non-operating condition, and movable to another position to release the operating means to allow operation of the equipment, and said piston in said first position thereof engages said locking means to hold said locking means in said one position and upon movement to said second position moves out of engagement with said locking means to allow said locking means to move to said other position.

Preferably the time delay device is adapted for use in combination with equipment in the form of a firing device demolition in which the locking means is a pivotal member and the operating means is a spring loaded firing pin with which one end of the pivotal member cooperates via an interengageable protrusion and notch arrangement, whereby upon pivoting of said pivotal member the protrusion and notch arrangement will disengage to release the firing pin which, under the action of said spring biasing, moves to a position to detonate an associated explosive element. In such an application of the invention the piston means is positioned such that a portion thereof abuts against the other end of the pivotal member of the firing device to prevent it pivoting to a position where the protrusion and notch arrangement disengages to release the firing pin, but upon full movement of the piston means it moves out of abutment with the end of the pivotal member to allow it to pivot to a disengaging position to release the firing pin.

In one preferred form of the invention, the piston means is a piston member supported in a housing which may, or may not, be formed integrally with the housing of the associated equipment, for example, the housing of the firing device demolition, and the biasing means to move the piston means in a biasing spring and the holding means for holding the piston means in engagement with the pivotal member is a holding pin passing through a hole in the housing and engaging in a groove around the piston member to hold the piston member in engagement with the locking means against the bias of the spring, but which upon being retracted or removed allows said piston member to move under the action of the spring bias.

Preferably the reservoir is a cylindrical chamber formed in said housing and one end of said piston member extends into one end of said chamber and carries a sealing means in sliding engagement with the wall of said chamber, with the opposite end of the chamber communicating with passage means in the form of a length of small bore or micro-bore tubing, the opposite end of which tubing may be sealed to prevent leakage and cut or severed prior to use of the device.

Alternatively, a cylindrical chamber is formed in the housing and the fluid reservoir is a sealed capsule of flexible material the interior of which communicates with passage means in the form of a length of small bore or micro-bore tubing, with the capsule being positioned within the chamber and acted upon by the piston member during movement thereof to compress the capsule to displace the fluid therefrom through the small bore or micro-bore tubing.

In a modification of this alternative preferred form of the invention the opposite end of the small bore or micro-bore tubing communicates with the interior of a further capsule of the same type which expands as fluid is displaced through the tubing and into it, such that after fluid has been displaced from the capsule acted upon by the piston member and into the capsule at the other end, the arrangement of capsules and tubing may be reused by reversing the arrangement and placing the filled capsule in the chamber in the housing to be acted upon by the piston member when the time delay device is reused.

Insofar as the viscosity of the fluid to be acted upon by the piston and to be displaced through the passage means is capable of variation with temperature changes, the time for the fluid to flow from said reservoir through said passage means, and therefore the time for the piston means to move from said first to said second positions will vary with temperature changes, and the consequent unpredictability of the time delay may in some circumstances be disadvantageous.

Therefore, in a further preferred form of the invention the time delay device incorporates a temperature compensating means to as much as possible ensure a pre-determined time interval for the piston means to move from the first to the second position irrespective of the temperature of the environment in which the device is used.

Several preferred embodiments of the invention, and as particularly applied to use with a firing device demolition, will now be described with reference to the accompanying drawings in which:

FIG. 1 is a side cross-sectional view through a time delay device in combination with a conventional firing device demolition.

Figure 2:
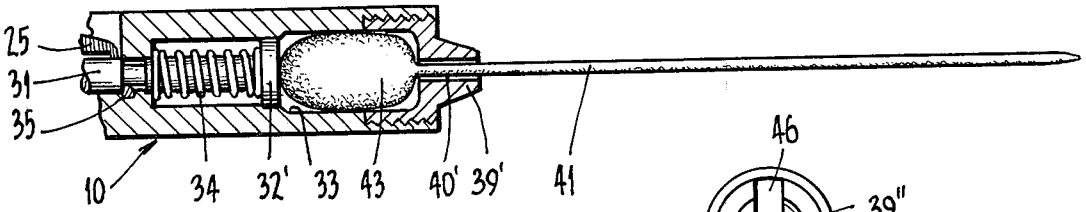
Figure 4:
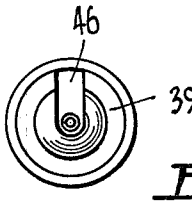
Figure 3:
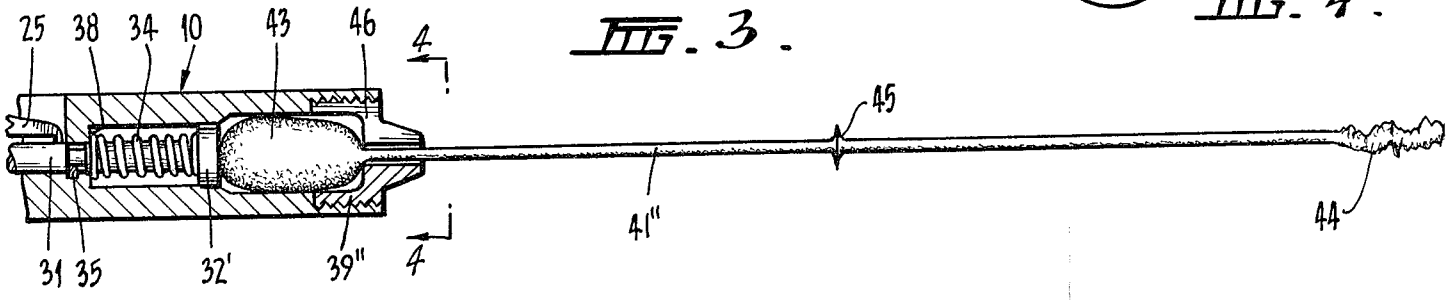
Figure 5:
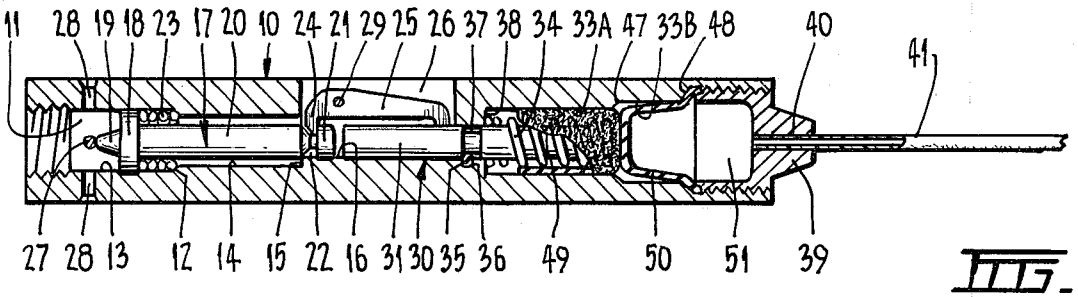
Figure 6:
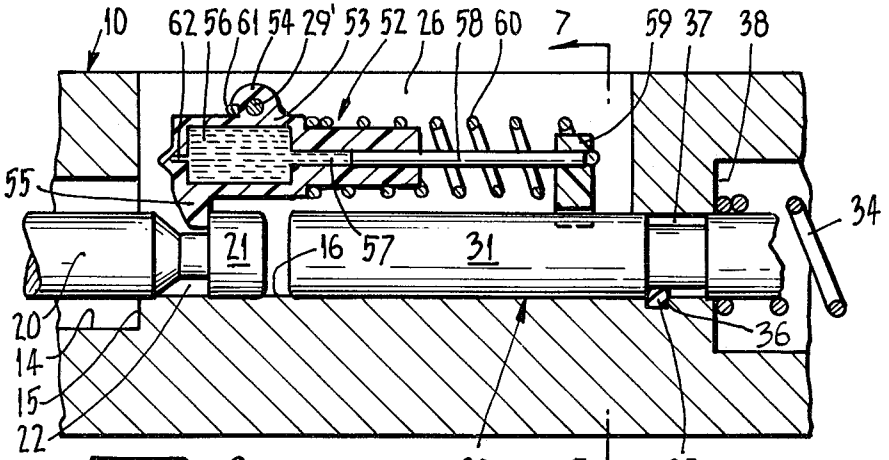

FIG. 2 is a side cross-sectional view of a modified form of the time delay device section of the combination of FIG. 1, FIG. 3 is a side cross-sectional view of a further modified form of the time delay device section of the combination of FIG. 2, FIG. 4 is a view in the direction of arrows 4—4 of the closure nut in the modified embodiment of FIG. 3, FIG. 5 is a side cross-sectional view of a still further modified form of the combination of FIG. 1, FIG. 6 is a side cross-sectional view of a temperature compensating means for use in the combinations of the embodiments of FIGS. 1 to 5, and FIG. 7 is a cross-sectional view taken along the line 7—7 of FIG. 6.

The firing device demolition section comprises a housing 10 incorporating an axial bore 11 opening through one end of the housing. The bore 11 is stepped at 12 to provide a larger diameter bore section 13 at the open end threaded internally for portion of its length as shown, and a smaller diameter section 14 within the housing, whilst the bore is further stepped at 15 to provide a still further small diameter bore section 16 within the housing. A firing pin 17 is received within the bore 11 and has an enlarged end portion 18 of a diameter matching that of the larger bore section 13 and from which protrudes a tapered point 19. The firing pin further includes a smaller diameter portion 20 extending predominently through the section 14 of the bore and an inner end portion 21 of the same diameter as the portion 20 and corresponding to the diameter of the section 16 of the bore 11, whilst being separated from the portion 20 by a circumferential groove 22, one side of which is tapered as shown. The firing pin 17 is biased towards the open end of the bore 11 by a compression coil spring 23 surrounding the end portion 20 of the firing pin adjacent the enlarged end portion 18 and between the enlarged end portion 18 and the step 12 of the bore 11. The firing pin is held in the position shown in FIG. 1 against the biasing action of the spring 23 by a sear 24 carried by a sear plate 25 supported in an opening 26 through the wall of the housing 10. A safety pin 27 is passed through one of a number of alternative transversely aligned holes 28 through the wall of a housing which, unless removed, will prevent full axial movement of the firing pin. The sear plate 25 is supported in the opening 26 by a pivot 29. Upon pivoting of the sear plate 25 about its pivot pin 29, the sear 24 moves out of engagement with the groove 22, and the firing pin 17 moves axially under the biasing action of the spring 23 to contact the explosive element (not shown).

The firing device demolition of FIG. 1 incorporates a time delay device in accordance with one preferred form of the invention, which time delay device comprises a piston member 30 having a stem 31 received and slidable within the bore section 16 and carrying a sealing cup washer 32 which fits in sliding sealing engagement with the wall of a cylindrical chamber 33 in an extension of the housing 10. In the position shown in FIG. 1 the end of the sear plate 25 opposite to the sear 24 bears against the stem 31 of the piston member and is prevented by the stem from pivoting about its pivot pin 29. The piston member 30 is biased toward the opposite end of the chamber 33 by a compression spring 34, but is held in the position shown in FIG. 1 against the action of the spring 34 by means of a holding pin 35 which passes through a hole in the wall of the housing and through a circular passage defined by a semi-circular groove 36 in the wall of the bore section 16 and a matching semi-circular groove 37 around the circumference of the stem 31 of the piston member 30. As shown, a step 38 is provided between the bore section 16 and the chamber 33 and the compression spring 34 is received between the step 38 and the cup washer 32. The end of the chamber 33 has a closure member 39 threadably received therein through which a passage 40 passes and communicates with a small bore or micro-bore tubing 41 which is preferably heat sealed at its other end, which seal is cut or severed when the device is to be put into use. The section of the chamber 33 between the cup washer 32 and the closure member 39 forms a fluid reservoir 42.

In use, when the holding pin 35 is retracted or removed, the piston member 30 is free to move under the biasing action of the compression spring 34 and acts to displace fluid from the reservoir 42 out through the small-bore or micro-bore tubing 41. The piston member 30 will move under the biasing action of the compression spring 34 at a rate dependent on how quickly fluid is displaced from the reservoir 42, which in turn is dependent on the size of the fluid path provided by the passage 40 and the tubing 41, the length of the tubing 41, the viscosity of the fluid and the spring rating of the compression spring 34, and after an elapse of time dictated by those factors the piston member 30 will move sufficiently to disengage from beneath the abutting end of the sear plate to release the sear plate for pivoting movement about pivot pin 29 to disengage the sear 24 from the groove 32 thus releasing the firing pin 17 for movement under the action of its biasing compression 23 to contact the explosive device, provided the safety pin 27 has been consequently removed which would normally be done at the time of retraction or removal of the holding pin 35.

In the modified form of the inventive time delay device as shown in FIG. 2, the same numerals are used for integers identical with those in FIG. 1, namely in relation to the housing 10, the piston member 30 with the stem 31, the chamber 33, the compression spring 34, the pin 35 and semi-circular grooves 36 and 37. In this modified form of the invention a sealing cup washer such as 32 in FIG. 1 is not necessary, and in place thereof a piston head 32' is provided which has a relatively close sliding fit within the chamber 33. In this modified form of the invention the chamber 33 between the piston head 32' and the closure member 39' receives a capsule 43 of flexible material the interior of which is filled with fluid and communicates with a small bore or micro-bore tube 41 which passes through a passage 40' through the closure 39', and which tube may be heat sealed at its opposite end. During the use of the modified form of the invention, when the release pin 35 is retracted or removed, the end of the tube 41' is also cut or severed, and the piston member 30 instead of acting directly on fluid in a reservoir formed by the chamber 33 acts on the capsule 43 to compress the capsule 43 and displace the fluid therefrom and out through the tube 41'.

In the further modified form of the time delay device of FIG. 3, the same numerals are used for the integers identical with those in FIG. 2, and in this modified form the opposite end of the small bore or micro-bore tubing 41'' communicates with a further capsule 44 which receives fluid displaced from the first capsule 43 through the tubing 41'' and expands accordingly. With this modified embodiment, the arrangement of capsules 43 and 44 are interconnecting tube 41'' can be reversed to allow the device to be re-used by inserting the expanded tube 44 full of fluid in the chamber 33 and on subsequent operation of the time delay device the fluid is displaced therefrom through the tubing 41'' and back to the capsule 43 for still further re-use. With reference to FIG. 4 of the drawings, the closure nut 39'' for the end of the chamber 43 has a slot 46 therein to enable the reversal function of the arrangement for re-use to be accomplished. In this modified embodiment the free ends of tubes such as in 41' in FIG. 2 may be heat sealed together at 45 to form the double capsule arrangement.

The further embodiment of FIG. 5 represents a modification of the embodiment of FIG. 1, and the same numerals for same components have once again been utilised.

In this modified embodiment the interior of the cylindrical chamber 33 is stepped at 47 to provide an inner smaller diameter section 33A and an outer larger diameter section 33B, and is stepped again to provide a shoulder 48 adjacent the threaded connection for the closure member 39.

Piston member 31 has a cylindrical head 49 (shown partly broken away) formed integrally therewith and extending back along, and surrounding, the piston member to define an annular space in which the spring 34 is received. The end of the piston member and cylindrical head combination bears against a cup-shaped flexible diaphragm 50 as shown, and the edge of the diaphragm 50 is in turn jammed and retained between the shoulder 48 and the closure member 39. The space 51 defined within the diaphragm 50 and the closure member 39 forms a reservoir for the fluid, and movement of the piston member causes the flexible diaphragm to flex and progressively move towards the closure member 39 to within the cavity shown in the closure member whilst the fluid is displaced through the tubing 41. In other respects the embodiment of FIG. 5 operates in the same manner as that of the embodiment of FIG. 1.

Figure 7:
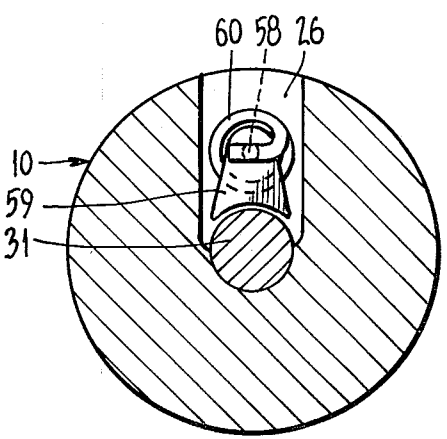

FIGS. 6 and 7 show a temperature compensating device, generally indicated as 52, which may be incorporated into the combination of the embodiments described previously in place of the pivotable sear plate 25. The effect of the temperature compensating device 52 is to enable automatic variation of the distance between the end of the compensating device at the point of engagement in the groove 22 in the firing pin and the opposite end which bears against the stem 31 of the piston member 30 dependent on the temperature of the surrounding environment, such that on an increase in temperature the distance will lengthen thus increasing the distance through which the piston member will have to move before the firing device demolition is actuated, whilst on a decrease in temperature the distance will shorten thus reducing the distance through the piston member will have to move before the firing device demolition is actuated.

In accordance with this preferred form of temperature compensating device there is provided a housing 53, having an enlargement at 54 through which a hole is provided to receive a pivot pin 29'. The housing also carries a protrusion 55 which engages the groove 22 around the firing pin and in that respect is equivalent to the sear 24 of the previous embodiments. The interior of the housing 53 has a chamber 56 filled with a temperature sensing fluid, such as, a mercury/thalium eutectic alloy. The chamber 56 communicates with a smaller diameter bore 57 within which one end of a compensator piston 58 is received. The other end of the compensator piston 58 extends beyond the end of the housing and carries a boot shaped member 59 which bears against the surface of the stem 31 of the piston member 30 in the same manner as the end of the sear plate of the preceding embodiments.

The boot shaped member 59 is biased towards the housing 53 by means of a tension coil spring 60, the coil at one end of which is coiled around the body of the housing 53 as shown, with the free end of the coil being retained in a groove 61 formed in the opposite side of the enlargement 54, whilst the opposite end of the spring is retained on the opposite of the boot shaped member 59 at a position where it bears against the end of the compensator piston 58 to act directly thereon and provide an axial force therein coincident with the axis of the compensator piston.

When manufacturing the temperature compensating device the chamber 56 and the communicating part of the bore 57 are charged with temperature sensitive fluid through a port 62 which is subsequently heat sealed after any excess is bled off.

In operation, if the temperature increases beyond that for which the device has been set to operate to provide a predetermined time delay, the temperature sensitive fluid responds to the temperature changes by expanding forcing the compensator piston 58 to the right as shown in FIG. 6 which has the effect of increasing the distance between the protrusion 55 and the boot shaped member 59, thus increasing the distance the piston member 30 must move before disengaging from beneath the boot shaped member, and therefore compensates for any reduction in time for the fluid flow through the small-bore or micro-bore tubing 41 which would result from the decreased viscosity of the fluid arising as a consequence of the increase in temperature of the surrounding environment. With a decrease in temperature, the tension spring 60 draws the boot shaped member back towards the housing 53 to force the compensator piston further into the housing to take up the decrease in volume of temperature sensitive fluid within the housing resulting from contraction of the fluid arising as a consequence of the decrease in temperature. The effective length between the protrusion 55 and the boot shaped member 59 is therefore reduced, the piston member 30 will then need to move through a lesser distance before disengaging from beneath the boot shaped member and thus compensation is made for the slower rate of transfer of fluid through the tubing 41 resulting from the increased viscosity of the fluid at the lower temperature.

In the embodiments described, the fluid used in the reservoir or capsules may be oil, but any other form of substantially non-compressible fluid, including both liquids or gases, or even fine granular material such as powders which exhibit fluid properties, may be used. The tubing is preferably small bore or micro-bore tubing, but may be larger bore tubing, and the tubing may be straight or coiled. The tubing may in fact be replaced by a passage formed through a solid body. In the case of tubing, it may be plastic tubing. In practice the tubing may be up to 30 cms long, and adjustment of the time delay may be achieved by cutting the tubing to a reduced length. The tubing may be calibrated under test conditions. In practice micro-bore tubing of 30 cms long and appropriate bore size may provide a time delay of up to 24 hours with an accuracy of $\pm 10$ minutes, and when shortened for shorter time delay durations of up to one half hour an accuracy of $\pm 10\%$ would be possible. If the tubing is cut to a minimum length, that is, flush with the closure 39, 39', or 39'', a time delay as short as 5 minutes is possible.

The housing 10 of the device, and many of the other components may be formed from a plastic material, or any other suitable material, although the firing pin and piston member may be manufactured from metallic materials such as steel.

As stated previously, although the invention is particularly applicable for use with firing device demolitions in the manner described in the preferred embodiments, it can also be applied for use with other forms of equipment or firing devices where a time delay between actuation and operation is required.

I claim:

1. A time delay device adapted to be used in cooperation with a piece of equipment for which a predetermined time delay is required between an actuating action and subsequent operation thereof; said time delay device comprising a piston means cooperating, in use, with said equipment, biasing means to move said piston means between a first position in which the equipment remains in a non-operating condition and a second position in which said equipment is allowed to operate, holding means to hold said piston means in said first position, a reservoir of fluid, having a predetermined viscosity, adapted to be acted upon by said piston means, said reservoir communicating with a length of small bore tubing, whereby upon movement of said piston means fluid will be displaced from said reservoir through said tubing, with the rate of movement of said piston means, and therefore the time for said piston means to move from said first to said second position under the action of said biasing means, being dictated by the viscosity of said fluid in the reservoir and the length of said tubing, thus providing for the predetermined time delay between actuation by release of said holding means and movement of said piston means under the action of said biasing means to said second position to allow operation of said equipment.

2. A time delay device as claimed in claim 1, wherein said piston means is a piston member supported in a housing, said biasing means is a biasing spring, and said holding means is a holding pin passing through a hole in the housing and engaging said piston means, said pin upon being retracted or removed allowing said piston member to move under the action of the spring bias.

3. A time delay device as claimed in claim 2, wherein the reservoir is a cylindrical chamber formed in said housing, one end of said piston member extending into one end of said chamber and carrying a sealing means in sliding engagement with the wall of said chamber, the opposite end of the chamber communicating with said tubing.

4. A time delay device as claimed in claim 3, wherein the opposite end of said tubing is sealed to prevent leakage and is cut or severed prior to use of the device.

5. A time delay device as claimed in claim 2, wherein a cylindrical chamber is formed in the housing, and said fluid reservoir is a sealed capsule of flexible material the interior of which communicates with said tubing, said capsule being positioned within the chamber and acted upon by said piston member during movement thereof to compress the capsule to displace the fluid therefrom through said tubing.

6. A time delay device as claimed in claim 5, wherein the opposite end of said tubing communicates with the interior of a second capsule of the same type which expands as fluid is displaced through said tubing and into it, whereby after fluid has been displaced from the capsule acted upon by the piston member into said second capsule, said capsules and tubing may be re-used by reversing the arrangement and placing the filled capsule in the chamber in the housing to be acted upon by the piston member when the time delay device is re-used.

7. A time delay device as claimed in any one of the preceding claims, wherein a temperature compensating means is provided to ensure a substantially predetermined time interval for the piston means to move thus allowing operation of said equipment irrespective of the temperature of the environment in which the device is used.

8. A time delay device as claimed in claim 1, in combination with equipment of the type having locking means cooperating with operating means and adapted in one position to hold said operating means in a non-operating condition, said locking means being movable to another position to release the operating means to allow operation of said equipment, said piston means in said first position thereof engaging said locking means to hold said locking means in said one position, said piston means upon movement to said second position moving out of engagement with said locking means to allow said locking means to move to said other position, and further including temperature compensating means for adjusting the second position to which said piston means moves to disengage from said locking means.

9. The combination of claim 8, wherein said equipment comprises a firing demolition device, in which the locking means is a pivotal member and the operating means is a spring loaded diring pin with which one end of the pivotal member cooperates via an interengageable protrusion and notch arrangement, whereby upon pivoting of said pivotal member the protrusion and notch arrangement will disengage to release the firing pin which, under the action of said spring biasing, moves to a position to detonate an associated explosive element, said piston means being positioned such that a portion thereof abuts against the other end of the pivotal member of the firing device to prevent said device from pivoting to a position where the protrusion and notch arrangement disengages to release the firing pin, but upon full movement of the piston means said device moves out of abutment with the end of the pivotal member to allow it to pivot to a disengaging position to release the firing pin.

10. The combination of claim 9, wherein said temperature compensating means is incorporated in said pivotal member and comprises a housing pivotally supported on said equipment and which constitutes said one end of said pivotal member, said housing having a chamber therein containing a temperature sensitive fluid which expands and contracts with increasing and decreasing temperature, the fluid in said chamber acting on one end of a compensating piston, the other end of which extends outwardly of said housing and carries means which constitutes said other end of said pivoting member, whereby, upon expansion of said fluid in said chamber the compensating piston will move to increase the distance of the means carried thereby from said housing, and upon contraction of said fluid in said chamber, said compensating piston and the means carried thereby will move to decrease the distance of said means from said housing.

* * * * *